US011090954B2

(12) United States Patent
Emoto et al.

(10) Patent No.: US 11,090,954 B2
(45) Date of Patent: Aug. 17, 2021

(54) IMAGE PRINTING APPARATUS

(71) Applicant: CANON KABUSHIKI KAISHA, Tokyo (JP)

(72) Inventors: Yuki Emoto, Tokyo (JP); Kosuke Yamamoto, Yokohama (JP); Norio Sakurai, Tokyo (JP); Toshiaki Somano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/423,361

(22) Filed: May 28, 2019

(65) Prior Publication Data

US 2019/0366741 A1 Dec. 5, 2019

(30) Foreign Application Priority Data

May 31, 2018 (JP) ..... JP2018-104695

(51) Int. Cl.
*B41J 13/10* (2006.01)
*B41J 29/02* (2006.01)
*B41J 11/58* (2006.01)

(52) U.S. Cl.
CPC ..... *B41J 11/58* (2013.01); *B41J 29/02* (2013.01)

(58) Field of Classification Search
CPC ..... B41J 13/106; B41J 11/58; B41J 29/02
See application file for complete search history.

(56) References Cited

U.S. PATENT DOCUMENTS 4,522,519 A 6/1985 DuBois
6,634,640 B1 * 10/2003 Yoshizawa ..... B65H 31/22 271/213
7,914,002 B2 3/2011 Yamada
8,820,742 B2 9/2014 Koyanagi et al.
9,169,101 B2 10/2015 Koyanagi et al.
2004/0141787 A1 * 7/2004 Inokuchi ..... B41J 3/4071 400/582

(Continued)

FOREIGN PATENT DOCUMENTS

CN 1276334 A 12/2000
CN 1991605 A 7/2007

(Continued)

OTHER PUBLICATIONS

U.S. Appl. No. 16/423,354, filed May 28, 2019 (First Named Inventor: Norio Sakurai).

(Continued)

*Primary Examiner* — Scott A Richmond
(74) *Attorney, Agent, or Firm* — Venable LLP

(57) ABSTRACT

An image printing apparatus has a first side plate and a second side plate that are part of a frame body housing an image printing unit and face each other in a widthwise direction crossing a discharging direction. The image printing apparatus also has a movable tray that is movable between the first side plate and the second side plate and receive a discharged print medium a support member that supports the movable tray in a movable manner. Further, the image printing apparatus has a drive unit that moves the movable tray and a frame that is fixed so as to couple the first side plate and the second side plate together in the widthwise direction, the support member and the drive unit being provided on the frame.

18 Claims, 13 Drawing Sheets

(56) References Cited

U.S. PATENT DOCUMENTS

| | | | | |
|---|---|---|---|---|
| 2013/0135390 | A1* | 5/2013 | Yamamoto | B41J 2/16517 347/42 |
| 2017/0008314 | A1 | 1/2017 | Asada et al. | |
| 2018/0272719 | A1* | 9/2018 | Sasaki | B41J 2/16523 |

FOREIGN PATENT DOCUMENTS

| | | | |
|---|---|---|---|
| CN | 103365148 | A | 10/2013 |
| JP | 2006-137610 | A | 6/2006 |
| JP | 2010-275098 | A | 12/2010 |

OTHER PUBLICATIONS

U.S. Appl. No. 16/416,483, filed May 20, 2019 (First Named Inventor: Toshiaki Somano).
U.S. Appl. No. 16/420,393, filed May 23, 2019 (First Named Inventor: Yuki Emoto).
Oct. 10, 2020 Chinese Official Action in Chinese Patent Appln. No. 201910430043.6.
Office Action dated Apr. 25, 2021, in Chinese Patent Application No. 201910430043.6.

* cited by examiner

IMAGE PRINTING APPARATUS

BACKGROUND OF THE INVENTION

Field of the Invention

The present invention relates to an image printing apparatus.

Description of the Related Art

Some image printing apparatuses have a capability of aligning a plurality of print medium, sequentially ejected, while sorting the print medium. Japanese Patent Laid-Open No. 2006-137610 discloses a discharge method for aligning print medium at different positions on a discharging tray for receiving the discharged print medium by moving the discharging tray in a horizontal direction with respect to a discharging port. Hereinafter, such a discharging process is referred to as "sorted discharging process." Since the "sorted discharging process" does not require a plurality of discharging trays for sorting, this process is suitable for relatively small apparatuses.

However, plural sorted stacks of print medium are placed on a single discharging tray in the "sorted discharging process," so that in a case of carrying out mass printing, there is a concern about bending or deformation of the discharging tray. In the "sorted discharging process", since the discharging tray with sorted stacks of print medium placed thereon is repeatedly moved and stopped, an inertial force corresponding to the mass also acts in a horizontal direction, so that a regulating guide may be deformed or an excessive load may be applied to the motor that moves the discharging tray. As a result, the movement of the discharging tray becomes unstable, so that appropriate sorting may not be performed.

SUMMARY OF THE INVENTION

The present invention has been made to solve the above problems. It is therefore an object of the present invention to provide an image printing apparatus capable of performing a "sorted discharging process" reliably and stably.

According to an aspect of the present invention, there is provided an image printing apparatus comprising: a first side plate and a second side plate configured to be part of a frame body housing an image printing unit and face each other in a widthwise direction crossing a discharging direction in which a print medium on which an image has been printed by the image printing unit is discharged; a movable tray configured to be movable between the first side plate and the second side plate in the widthwise direction, and receive a discharged print medium; a support member configured to support the movable tray in a movable manner; a drive unit configured to move the movable tray; and a frame configured to be fixed so as to couple the first side plate and the second side plate together in the widthwise direction, the support member and the drive unit being provided on the frame. Further features of the present invention will become apparent from the following description of exemplary embodiments with reference to the attached drawings.

DESCRIPTION OF THE EMBODIMENTS

Figure 1:
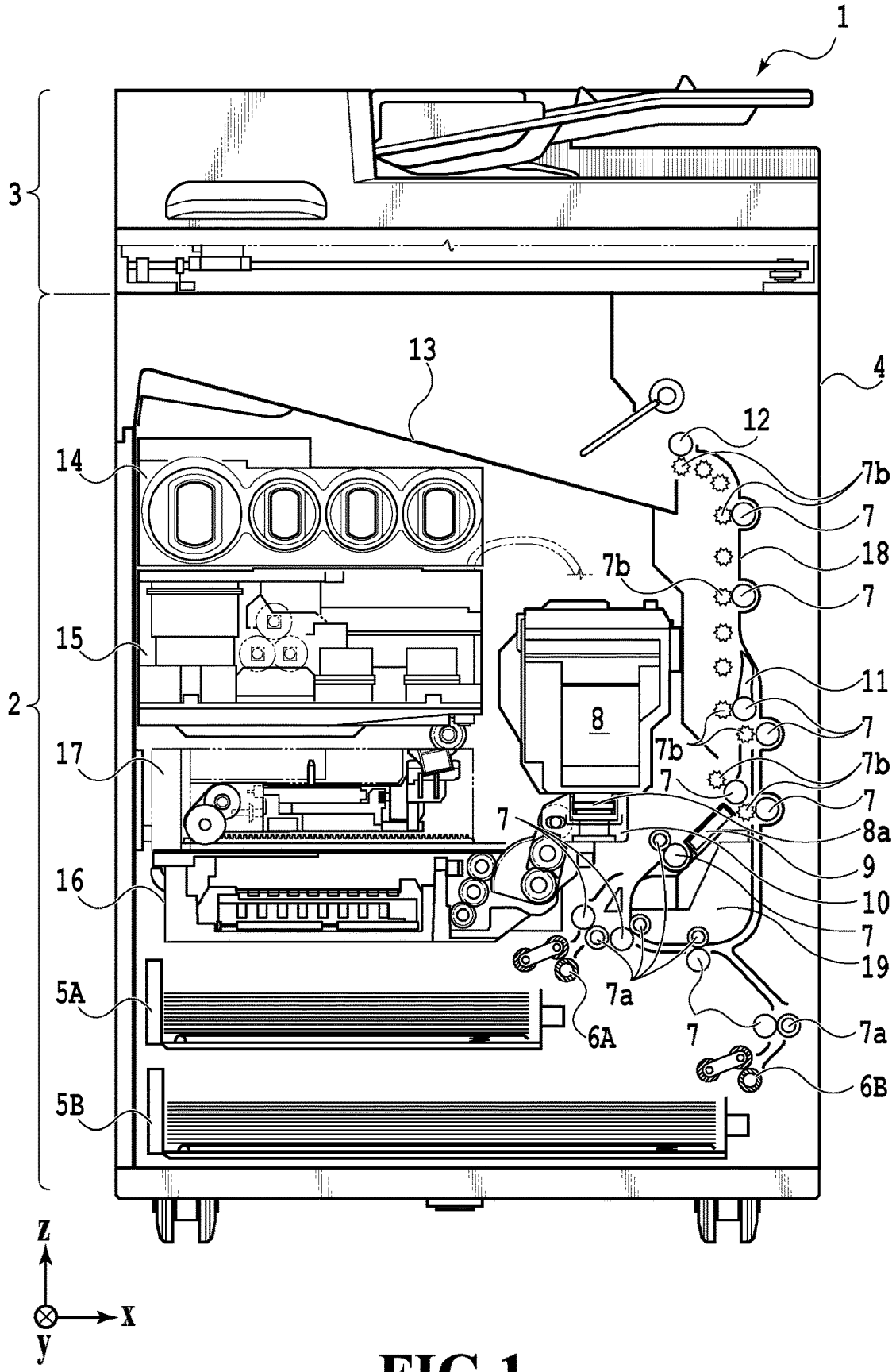
FIG. 1 is a diagram showing a printing apparatus in a standby state.

FIG. 1 is an internal configuration diagram of an inkjet printing apparatus 1 (hereinafter "printing apparatus 1") used in the present embodiment. In the drawings, an x-direction is a horizontal direction, a y-direction (a direction perpendicular to paper) is a direction in which ejection openings are arrayed in a print head 8 described later, and a z-direction is a vertical direction.

The printing apparatus 1 is a multifunction printer comprising a print unit 2 and a scanner unit 3. The printing apparatus 1 can use the print unit 2 and the scanner unit 3 separately or in synchronization to perform various processes related to print operation and scan operation. The scanner unit 3 comprises an automatic document feeder (ADF) and a flatbed scanner (FBS) and is capable of scanning a document automatically fed by the ADF as well as scanning a document placed by a user on a document plate of the FBS. The present embodiment is directed to the multifunction printer comprising both the print unit 2 and the scanner unit 3, but the scanner unit 3 may be omitted. FIG. 1 shows the printing apparatus 1 in a standby state in which neither print operation nor scan operation is performed.

In the print unit 2, a first cassette 5A and a second cassette 5B for housing print medium (cut sheets) S are detachably provided at the bottom of a casing 4 in the vertical direction. Relatively small print medium of up to A4 size are stacked and housed in the first cassette 5A and relatively large print medium of up to A3 size are stacked and housed in the second cassette 5B. A first feeding unit 6A for feeding housed print medium one by one is provided near the first cassette 5A. Similarly, a second feeding unit 6B is provided near the second cassette 5B. In print operation, a print medium S is selectively fed from either one of the cassettes.

Conveying rollers 7, a discharging roller 12, pinch rollers 7*a*, spurs 7*b*, a guide 18, an inner guide 19, and a flapper 11 are conveying mechanisms for guiding a print medium S in a predetermined direction. The conveying rollers 7 are drive rollers located upstream and downstream of the print head 8 (platen 9) and driven by a conveying motor. The pinch rollers 7*a* are follower rollers that are turned while nipping a print medium S together with the conveying rollers 7. The discharging roller 12 is a drive roller located downstream of the conveying rollers 7 and driven by a discharging motor. The spurs 7*b* nip and convey a print medium S together with the conveying rollers 7 and discharging roller 12 located downstream of the print head 8 (platen 9).

The printing apparatus 1 is provided with a plurality of motors for driving the drive rollers, each of which is connected to one of the plurality of motors. The correspondence relation between the motors and the drive rollers will be described in detail later.

The guide 18 is provided in a conveying path of a print medium S to guide the print medium S in a predetermined direction. The inner guide 19 is a member extending in the y-direction. The inner guide 19 has a curved side surface and guides a print medium S along the side surface. The flapper 11 is a member for changing a direction in which a print medium S is conveyed in duplex print operation. A discharging tray 13 is a tray for stacking and housing print medium S that were subjected to print operation and discharged by the discharging roller 12.

The print head 8 of the present embodiment is a full line type color inkjet print head. In the print head 8, a plurality of ejection openings configured to eject ink based on print data are arrayed in the y-direction in FIG. 1 so as to correspond to the width of a print medium S. When the print head 8 is in a standby position, an ejection opening surface 8*a* of the print head 8 is oriented vertically downward and capped with a cap unit 10 as shown in FIG. 1. In print operation, the orientation of the print head 8 is changed by a print controller 202 described later such that the ejection opening surface 8*a* faces a platen 9. The platen 9 includes a flat plate extending in the y-direction and supports a print medium S being subjected to print operation by the print head 8 from the back side. The movement of the print head 8 from the standby position to a printing position will be described later in detail.

An ink tank unit 14 separately stores inks of four colors to be supplied to the print head 8. An ink supply unit 15 is provided in the midstream of a flow path connecting the ink tank unit 14 to the print head 8 to adjust the pressure and flow rate of ink in the print head 8 within a suitable range. The present embodiment adopts a circulation type ink supply system, where the ink supply unit 15 adjusts the pressure of ink supplied to the print head 8 and the flow rate of ink collected from the print head 8 within a suitable range.

A maintenance unit 16 comprises the cap unit 10 and a wiping unit 17 and activates them at predetermined timings to perform maintenance operation for the print head 8. The maintenance operation will be described later in detail.

Figure 2:
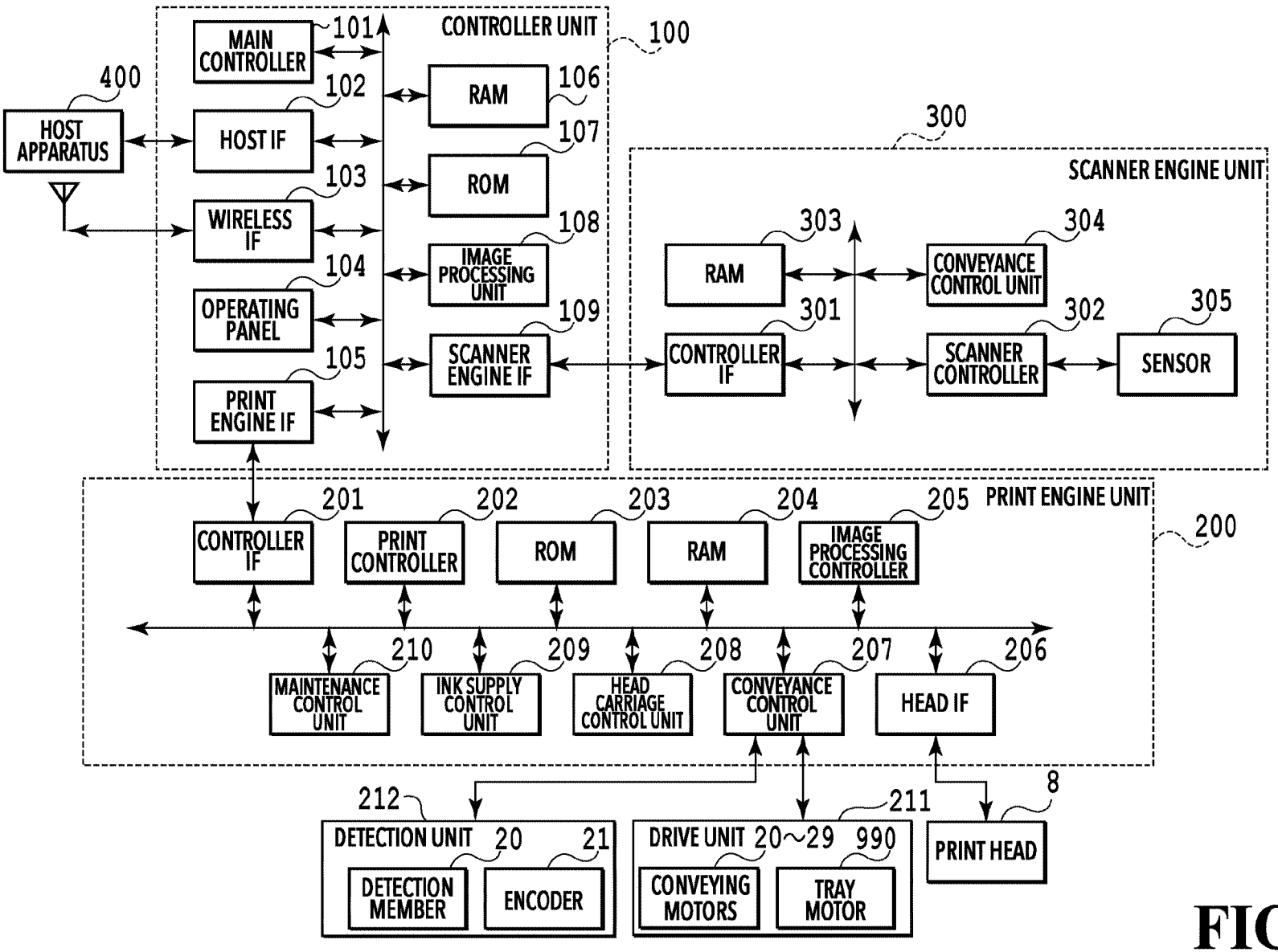
FIG. 2 is a control configuration diagram of the printing apparatus.

FIG. 2 is a block diagram showing a control configuration in the printing apparatus 1. The control configuration mainly includes a print engine unit 200 that exercises control over the print unit 2, a scanner engine unit 300 that exercises control over the scanner unit 3, and a controller unit 100 that exercises control over the entire printing apparatus 1. A print controller 202 controls various mechanisms of the print engine unit 200 under instructions from a main controller 101 of the controller unit 100. Various mechanisms of the scanner engine unit 300 are controlled by the main controller 101 of the controller unit 100. The control configuration will be described below in detail.

In the controller unit 100, the main controller 101 including a CPU controls the entire printing apparatus 1 using a RAM 106 as a work area in accordance with various parameters and programs stored in a ROM 107. For example, when a print job is input from a host apparatus 400 via a host I/F 102 or a wireless I/F 103, an image processing unit 108 executes predetermined image processing for received image data under instructions from the main controller 101. The main controller 101 transmits the image data subjected to the image processing to the print engine unit 200 via a print engine I/F 105.

The printing apparatus 1 may acquire image data from the host apparatus 400 via a wireless or wired communication or acquire image data from an external storage unit (such as a USB memory) connected to the printing apparatus 1. A communication system used for the wireless or wired communication is not limited. For example, as a communication system for the wireless communication, Wi-Fi (Wireless Fidelity; registered trademark) and Bluetooth (registered trademark) can be used. As a communication system for the wired communication, a USB (Universal Serial Bus) and the like can be used. For example, when a scan command is input from the host apparatus 400, the main controller 101 transmits the command to the scanner unit 3 via a scanner engine I/F 109.

An operating panel 104 is a mechanism to allow a user to do input and output for the printing apparatus 1. A user can give an instruction to perform operation such as copying and scanning, set a print mode, and recognize information about the printing apparatus 1 via the operating panel 104.

In the print engine unit 200, the print controller 202 including a CPU controls various mechanisms of the print unit 2 using a RAM 204 as a work area in accordance with various parameters and programs stored in a ROM 203. When various commands and image data are received via a controller I/F 201, the print controller 202 temporarily stores them in the RAM 204. The print controller 202 allows an image processing controller 205 to convert the stored image data into print data such that the print head 8 can use it for print operation. After the generation of the print data, the print controller 202 allows the print head 8 to perform print operation based on the print data via a head I/F 206. At this time, the print controller 202 controls conveying and discharging of a print medium S by driving the feeding units 6A and 6B, conveying rollers 7, discharging roller 12, and flapper 11 shown in FIG. 1 and a movable tray 950 (not shown in FIG. 1) via a conveyance control unit 207.

The conveyance control unit 207 is connected to a detection unit 212 that detects the conveyance state of a print medium S, and a drive unit 211 that drives a plurality of drive rollers and the discharging tray 13. The detection unit 212 includes detection members 20 for each detecting the presence/absence of a print medium S, and an encoder 21 for detecting the amounts of rotation of the drive rollers. The drive unit 211 includes a tray motor 990 for driving the discharging tray 13 in addition to a plurality of motors 22 to 29 for feeding and conveying a print medium S.

The conveyance control unit 207 controls the conveyance of a print medium S by using the drive unit 211 based on the result of detection obtained from the detection unit 212. During the conveyance of a print medium S under control of the conveyance control unit 207, print operation is performed to carry out a printing process by the print head 8 in response to an instruction from the print controller 202. In addition, in a case where a "sorted discharging process" is set in a print command, the conveyance control unit 207 drives the tray motor 990 to sort discharged print medium on the discharging tray 13.

A head carriage control unit 208 changes the orientation and position of the print head 8 in accordance with an operating state of the printing apparatus 1 such as a maintenance state or a printing state. An ink supply control unit 209 controls the ink supply unit 15 such that the pressure of ink supplied to the print head 8 is within a suitable range. A maintenance control unit 210 controls the operation of the cap unit 10 and wiping unit 17 in the maintenance unit 16 when performing maintenance operation for the print head 8.

In the scanner engine unit 300, the main controller 101 controls hardware resources of the scanner controller 302 using the RAM 106 as a work area in accordance with various parameters and programs stored in the ROM 107, thereby controlling various mechanisms of the scanner unit 3. For example, the main controller 101 controls hardware resources in the scanner controller 302 via a controller I/F 301 to cause a conveyance control unit 304 to convey a document placed by a user on the ADF and cause a sensor 305 to scan the document. The scanner controller 302 stores scanned image data in a RAM 303. The print controller 202 can convert the image data acquired as described above into print data to enable the print head 8 to perform print operation based on the image data scanned by the scanner controller 302.

Figure 3:
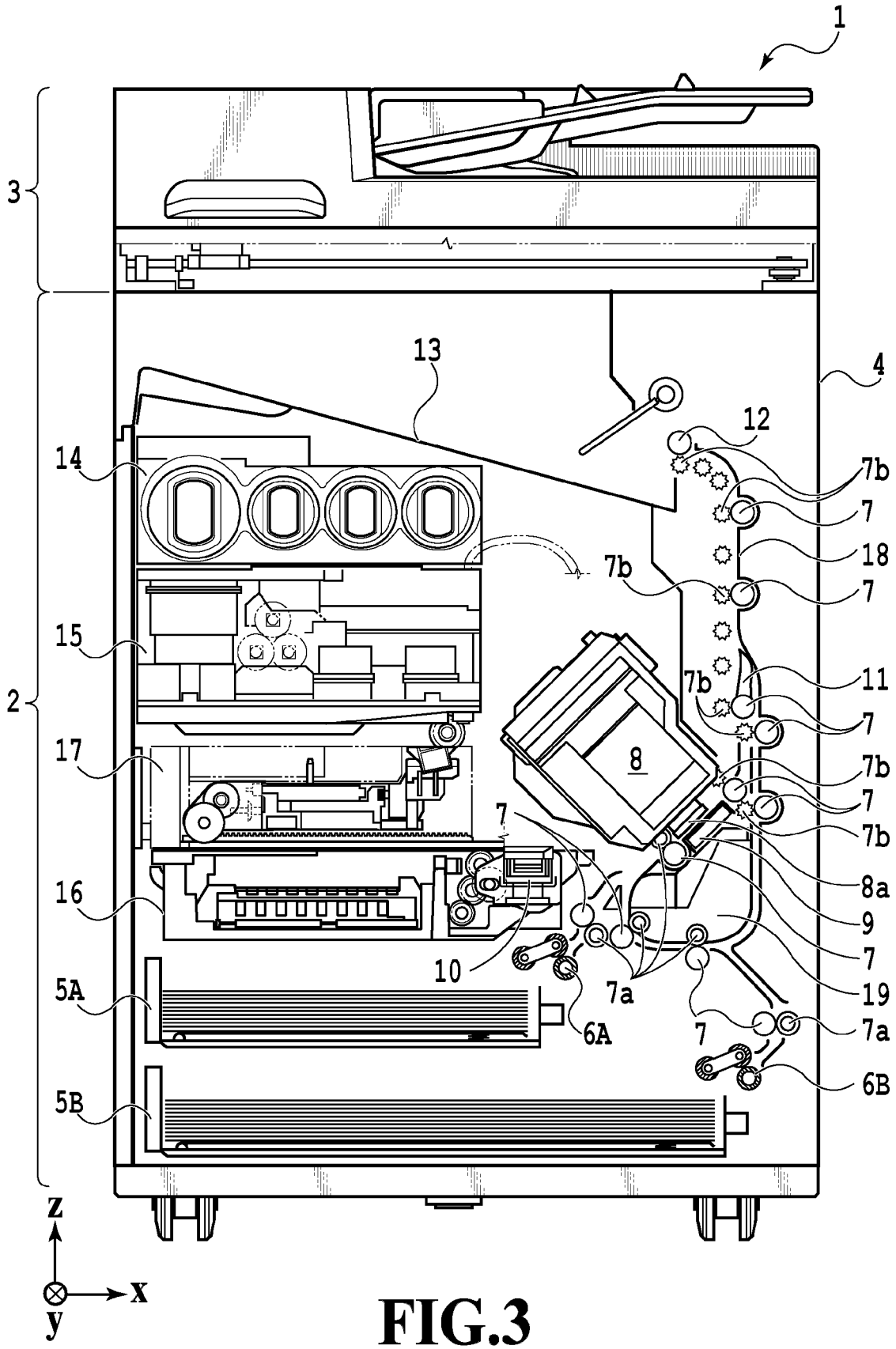
FIG. 3 is a diagram showing the printing apparatus in a printing state.

FIG. 3 shows the printing apparatus 1 in a printing state. As compared with the standby state shown in FIG. 1, the cap unit 10 is separated from the ejection opening surface 8*a* of the print head 8 and the ejection opening surface 8*a* faces the platen 9. In the present embodiment, the plane of the platen 9 is inclined about 45° with respect to the horizontal plane. The ejection opening surface 8*a* of the print head 8 in a printing position is also inclined about 45° with respect to the horizontal plane so as to keep a constant distance from the platen 9.

In the case of moving the print head 8 from the standby position shown in FIG. 1 to the printing position shown in FIG. 3, the print controller 202 uses the maintenance control unit 210 to move the cap unit 10 down to an evacuation position shown in FIG. 3, thereby separating a cap member 10*a* from the ejection opening surface 8*a* of the print head 8. The print controller 202 then uses the head carriage control unit 208 to turn the print head 8 45° while adjusting the vertical height of the print head 8 such that the ejection opening surface 8*a* faces the platen 9. After the completion of print operation, the print controller 202 reverses the above procedure to move the print head 8 from the printing position to the standby position.

Next, a conveying path of a print medium S in the print unit 2 will be described. When a print command is input, the print controller 202 first uses the maintenance control unit 210 and the head carriage control unit 208 to move the print head 8 to the printing position shown in FIG. 3. The print controller 202 then uses the conveyance control unit 207 to drive either the first feeding unit 6A or the second feeding unit 6B in accordance with the print command and feed a print medium S.

Figure 4C:
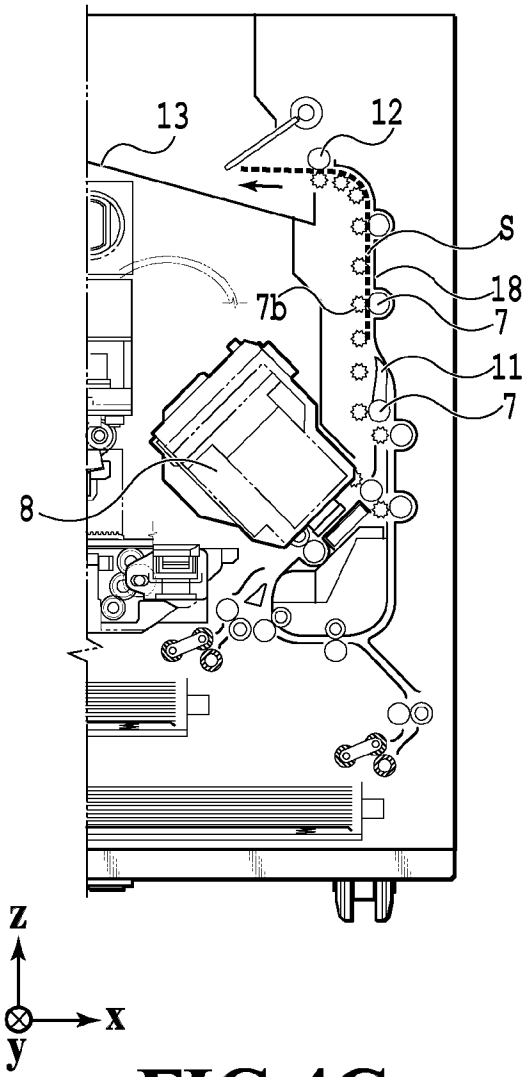
FIGS. 4A to 4C are diagrams showing a conveying path for a print medium fed from a first cassette.
Figure 4B:
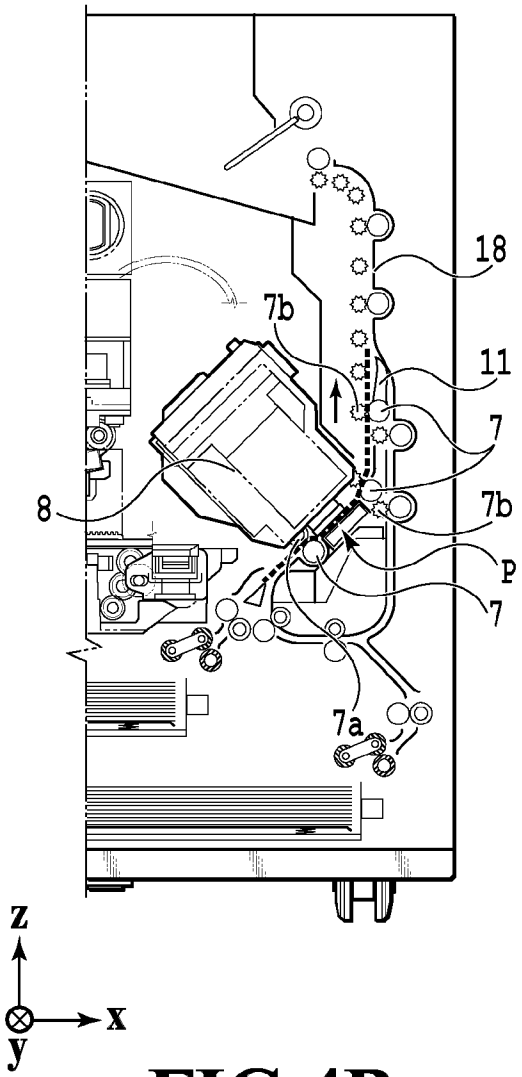
Figure 4A:
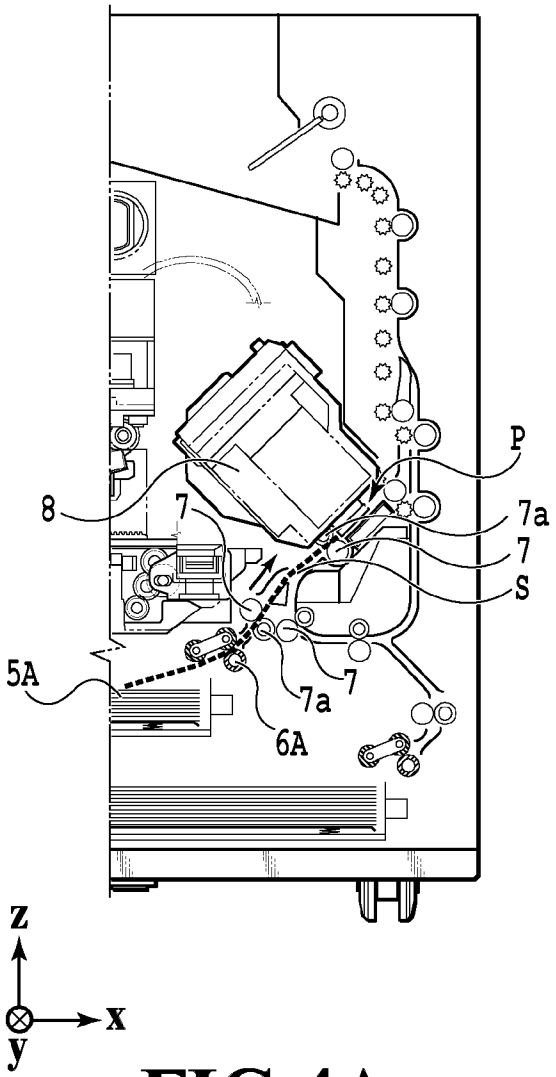

FIGS. 4A to 4C are diagrams showing a conveying path in the case of feeding an A4 size print medium S from the first cassette 5A. A print medium S at the top of a stack of print medium in the first cassette 5A is separated from the rest of the stack by the first feeding unit 6A and conveyed toward a print area P between the platen 9 and the print head 8 while being nipped between the conveying rollers 7 and the pinch rollers 7*a*. FIG. 4A shows a conveying state where the front end of the print medium S is about to reach the print area P. The direction of movement of the print medium S is changed from the horizontal direction (x-direction) to a direction inclined about 45° with respect to the horizontal direction while being fed by the first feeding unit 6A to reach the print area P.

In the print area P, a plurality of ejection openings provided in the print head 8 eject ink toward the print medium S. In an area where ink is applied to the print medium S, the back side of the print medium S is supported by the platen 9 so as to keep a constant distance between the ejection opening surface 8*a* and the print medium S. After ink is applied to the print medium S, the conveying rollers 7 and the spurs 7*b* guide the print medium S such that the print medium S passes on the left of the flapper 11 with its tip inclined to the right and is conveyed along the guide 18 in the vertically upward direction of the printing apparatus 1. FIG. 4B shows a state where the front end of the print medium S has passed through the print area P and the print medium S is being conveyed vertically upward. The conveying rollers 7 and the spurs 7*b* change the direction of movement of the print medium S from the direction inclined about 45° with respect to the horizontal direction in the print area P to the vertically upward direction.

After being conveyed vertically upward, the print medium S is discharged into the discharging tray 13 by the discharging roller 12 and the spurs 7*b*. FIG. 4C shows a state where the front end of the print medium S has passed through the discharging roller 12 and the print medium S is being discharged into the discharging tray 13. The discharged print medium S is held in the discharging tray 13 with the side on which an image was printed by the print head 8 down.

Figure 5C:
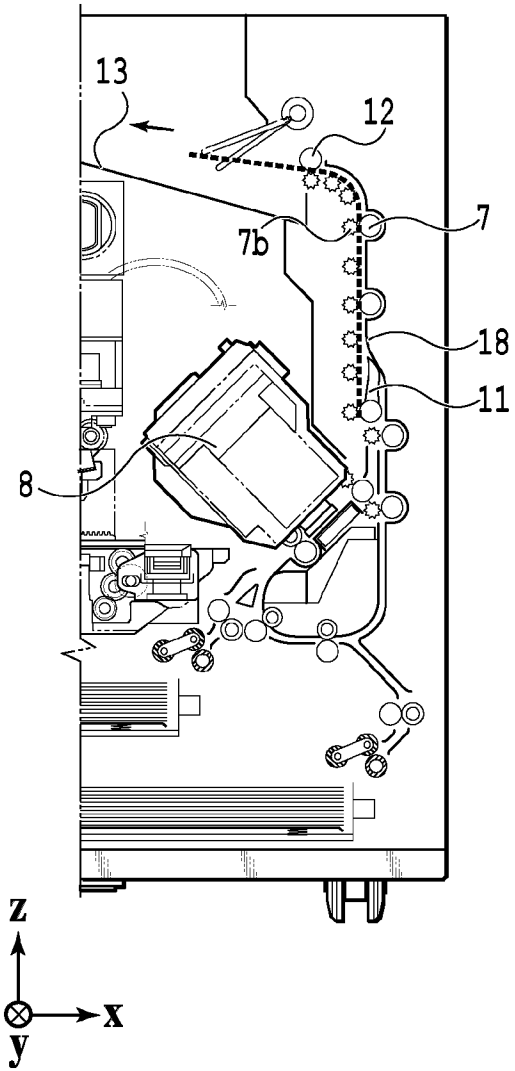
FIGS. 5A to 5C are diagrams showing a conveying path for a print medium fed from a second cassette.
Figure 5B:
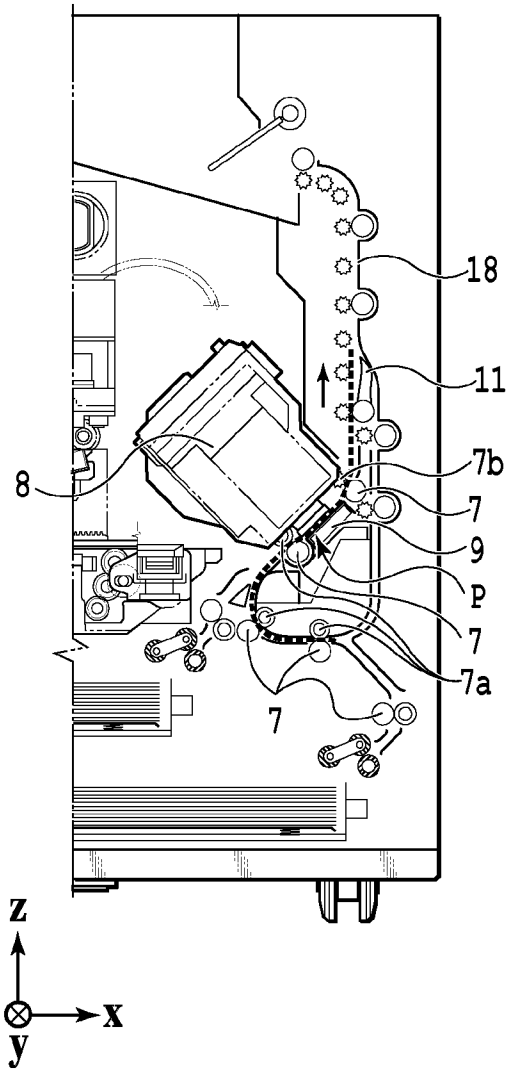
Figure 5A:
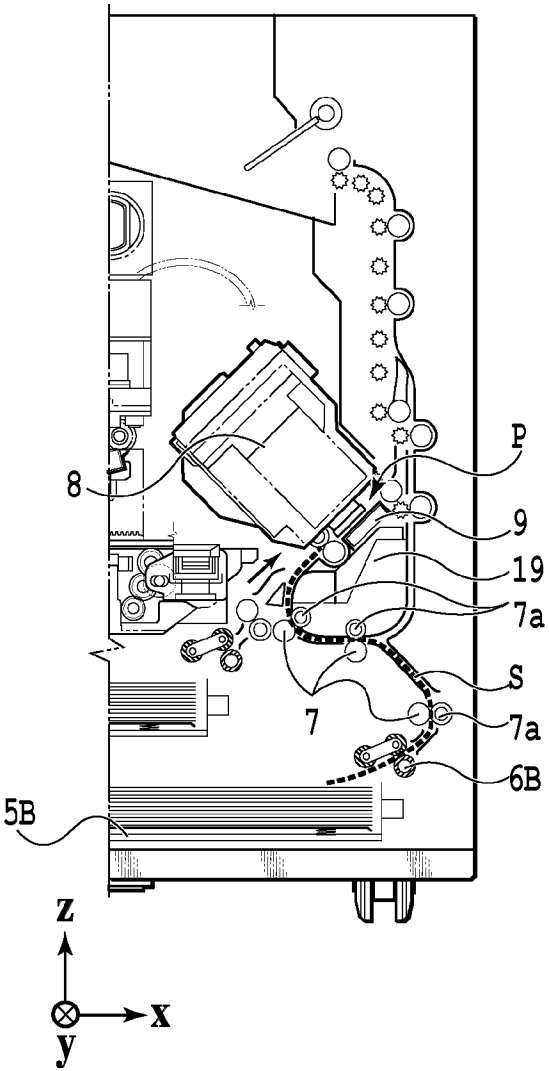

FIGS. 5A to 5C are diagrams showing a conveying path in the case of feeding an A3 size print medium S from the second cassette 5B. A print medium S at the top of a stack of print medium in the second cassette 5B is separated from the rest of the stack by the second feeding unit 6B and conveyed toward the print area P between the platen 9 and the print head 8 while being nipped between the conveying rollers 7 and the pinch rollers 7*a*.

FIG. 5A shows a conveying state where the front end of the print medium S is about to reach the print area P. In a part of the conveying path, through which the print medium S is fed by the second feeding unit 6B toward the print area P, the plurality of conveying rollers 7, the plurality of pinch rollers 7*a*, and the inner guide 19 are provided such that the print medium S is conveyed to the platen 9 while being bent into an S-shape.

The rest of the conveying path is the same as that in the case of the A4 size print medium S shown in FIGS. 4B and 4C. FIG. 5B shows a state where the front end of the print medium S has passed through the print area P and the print medium S is being conveyed vertically upward. FIG. 5C shows a state where the front end of the print medium S has passed through the discharging roller 12 and the print medium S is being discharged into the discharging tray 13.

FIGS. 6A to 6D show a conveying path in the case of performing print operation (duplex printing) for the back side (second side) of an A4 size print medium S. In the case of duplex printing, print operation is first performed for the first side (front side) and then performed for the second side (back side). A conveying procedure during print operation for the first side is the same as that shown in FIGS. 4A to 4C and therefore description will be omitted. A conveying procedure subsequent to FIG. 4C will be described below.

Figures 6A, 6B, 6C, 6D:
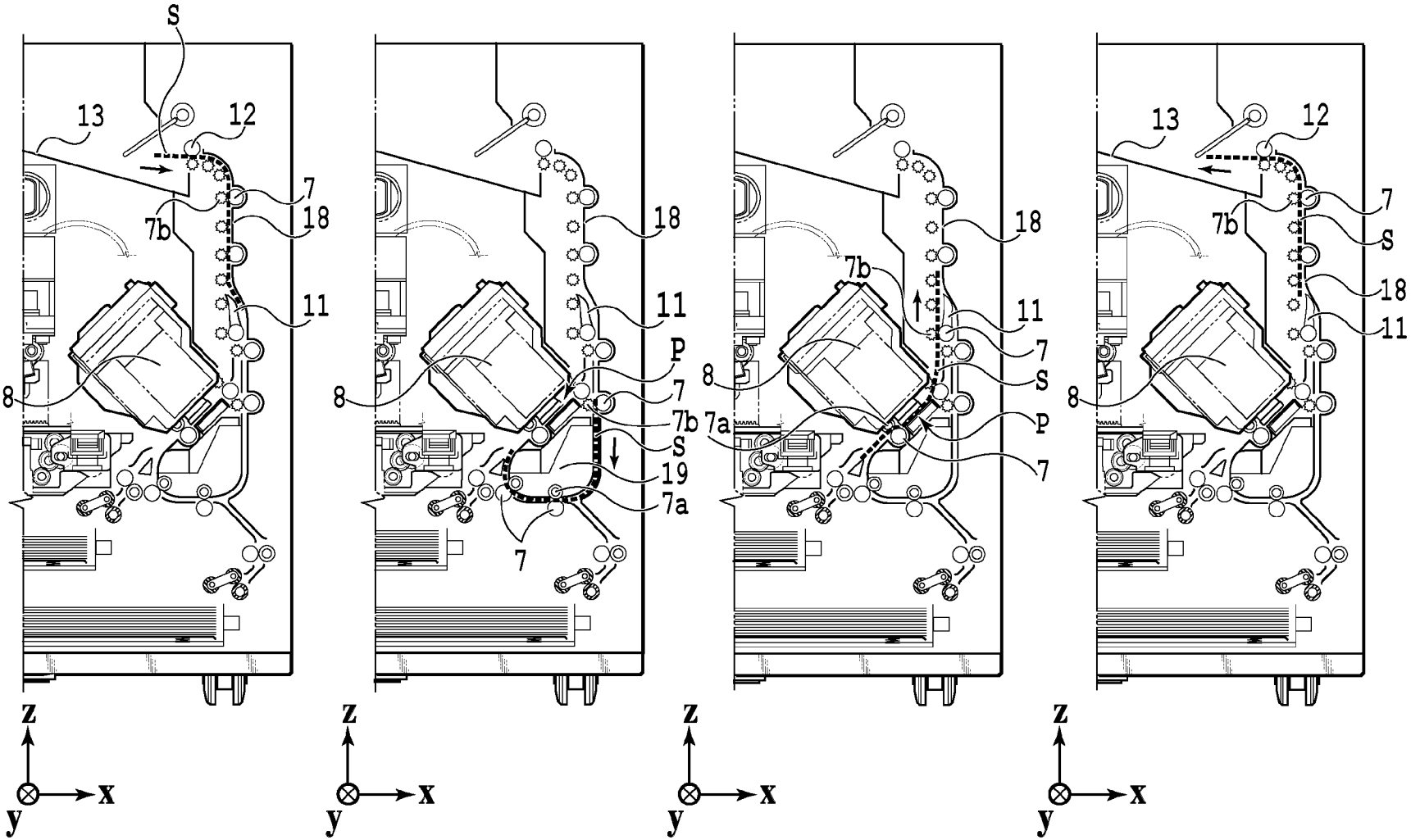
FIGS. 6A to 6D are diagrams showing a conveying path in the case of performing print operation on the back side of a print medium.

After the print head 8 finishes print operation for the first side and the back end of the print medium S passes by the flapper 11, the print controller 202 turns the conveying rollers 7 backward to convey the print medium S into the printing apparatus 1. At this time, since the flapper 11 is controlled by an actuator (not shown) such that the tip of the flapper 11 is inclined to the left, the front end of the print medium S (corresponding to the back end during the print operation for the first side) passes on the right of the flapper 11 and is conveyed vertically downward. FIG. 6A shows a state where the front end of the print medium S (corresponding to the back end during the print operation for the first side) is passing on the right of the flapper 11.

Then, the print medium S is conveyed along the curved outer surface of the inner guide 19 and then conveyed again to the print area P between the print head 8 and the platen 9. At this time, the second side of the print medium S faces the ejection opening surface 8*a* of the print head 8. FIG. 6B shows a conveying state where the front end of the print medium S is about to reach the print area P for print operation for the second side.

The rest of the conveying path is the same as that in the case of the print operation for the first side shown in FIGS. 4B and 4C. FIG. 6C shows a state where the front end of the print medium S has passed through the print area P and the print medium S is being conveyed vertically upward. At this time, the flapper 11 is controlled by the actuator (not shown) such that the tip of the flapper 11 is inclined to the right. FIG. 6D shows a state where the front end of the print medium S has passed through the discharging roller 12 and the print medium S is being discharged into the discharging tray 13.

Next, maintenance operation for the print head 8 will be described. As described with reference to FIG. 1, the maintenance unit 16 of the present embodiment comprises the cap unit 10 and the wiping unit 17 and activates them at predetermined timings to perform maintenance operation.

Figure 7:
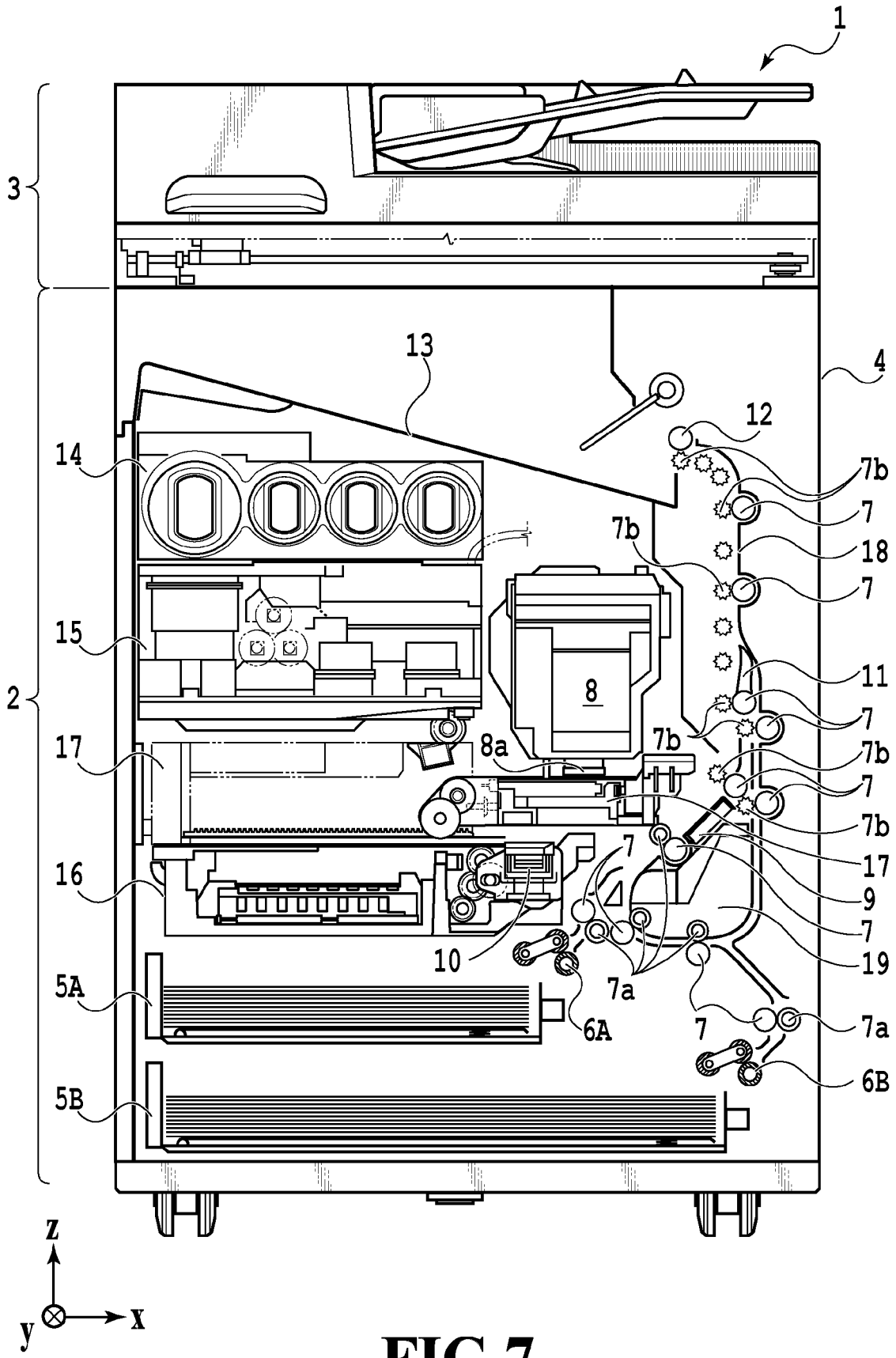
FIG. 7 is a diagram showing the printing apparatus in a maintenance state.

FIG. 7 is a diagram showing the printing apparatus 1 in a maintenance state. In the case of moving the print head 8 from the standby position shown in FIG. 1 to a maintenance position shown in FIG. 7, the print controller 202 moves the print head 8 vertically upward and moves the cap unit 10 vertically downward. The print controller 202 then moves the wiping unit 17 from the evacuation position to the right in FIG. 7. After that, the print controller 202 moves the print head 8 vertically downward to the maintenance position where maintenance operation can be performed.

On the other hand, in the case of moving the print head 8 from the printing position shown in FIG. 3 to the maintenance position shown in FIG. 7, the print controller 202 moves the print head 8 vertically upward while turning it 45°. The print controller 202 then moves the wiping unit 17 from the evacuation position to the right. Following that, the print controller 202 moves the print head 8 vertically downward to the maintenance position where maintenance operation can be performed.

Figure 8:
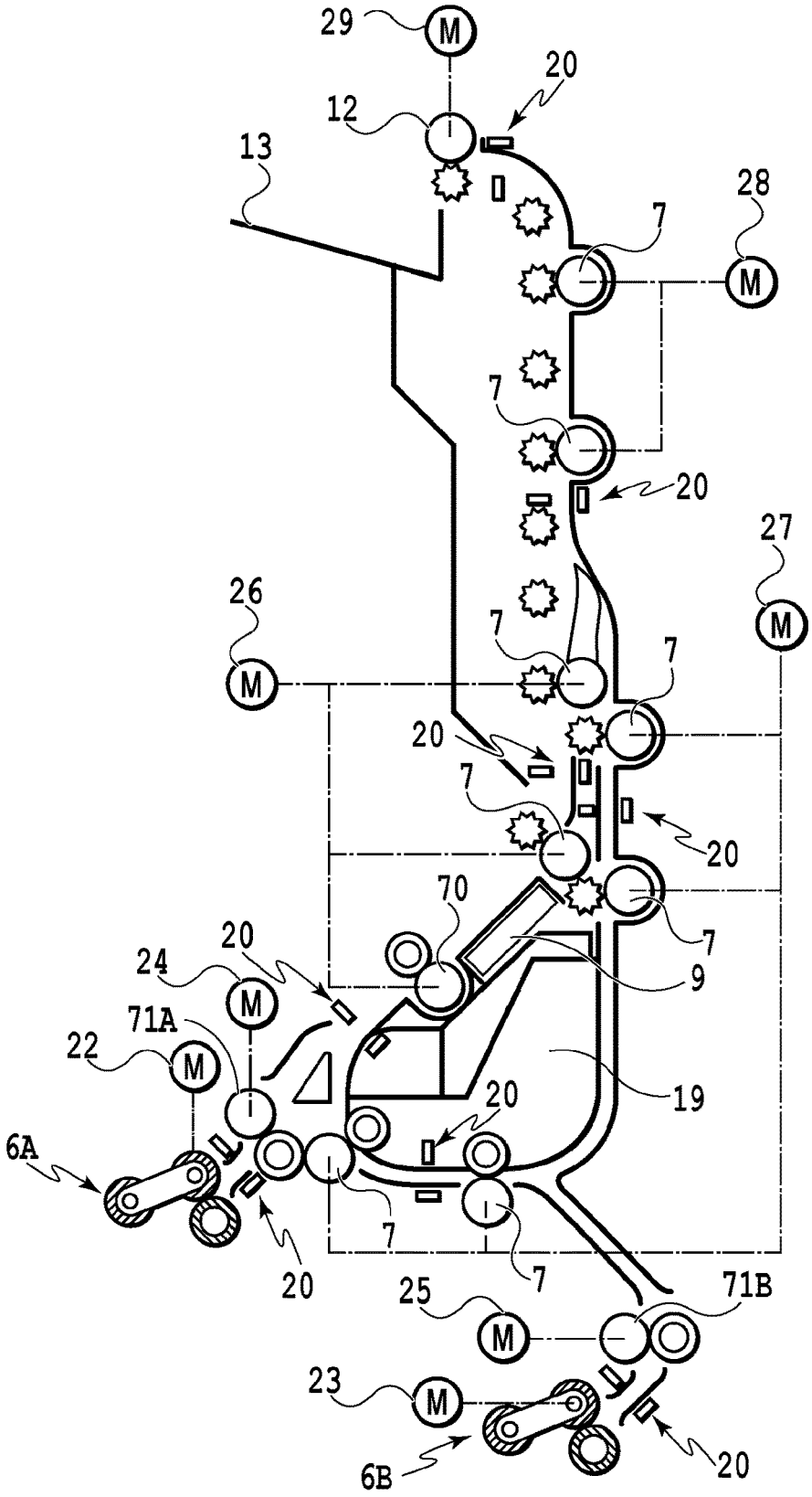
FIG. 8 is a diagram showing the correspondence relation between drive rollers and motors.

FIG. 8 is a diagram showing the correspondence relation between a plurality of motors and drive rollers in the printing apparatus 1. A first feeding motor 22 drives the first feeding unit 6A for feeding a print medium S from the first cassette 5A. A second feeding motor 23 drives the second feeding unit 6B for feeding a print medium S from the second cassette 5B. A first conveying motor 24 drives a first intermediate roller 71A first that conveys a print medium S fed by the first feeding unit 6A. A second conveying motor 25 drives a second intermediate roller 71B first that conveys a print medium S fed by the second feeding unit 6B.

A main conveying motor 26 drives a main conveyance roller 70 that is disposed upstream of the platen 9 and mainly conveys a print medium S which is being printed. The main conveying motor 26 also drives two conveyance rollers 7 that are disposed downstream of the platen 9 and convey, further downstream, a print medium S which is conveyed by the main conveyance roller 70.

A third conveying motor 27 drives two conveyance rollers 7 that convey a print medium S downward whose first side has been subjected to printing. The third conveying motor 27 also drives two conveyance rollers 7 that are disposed along the inner guide 19 and convey to the print head 8 a print medium S which is fed from the second cassette 5B and conveyed toward the second intermediate roller 71B, or a print medium S whose first side has been subjected to printing and which is flipped over.

A fourth conveying motor 28 drives two conveyance rollers 7 that convey upward or downward a print medium S whose printing has been finished. A discharging motor 29 dives the discharging roller 12 that discharges a print medium S whose printing has been finished onto the discharging tray 13. As apparent from above, each of the two feeding motors 22, 23, the five conveying motors 24 to 28, and the discharging motor 29 is associated with one or more drive rollers.

The detection members 20 for each detecting the presence/absence of a print medium S are disposed at eight locations along the conveying path. Each detection member 20 comprises a sensor a mirror which are disposed to face each other with the conveying path in between; the sensor including a light emitting unit and a light receiving unit is disposed on one side of the conveying path, and the mirror is disposed on the opposite side of the conveying path at a position facing the sensor. Light emitted from the light emitting unit of the sensor is reflected at the mirror, and the presence/absence of a print medium S, that is, passing of the leading end or the trailing end of a print medium S is discriminated by whether the light receiving unit has detected the reflected light.

The conveyance control unit 207 individually drives the feeding motors 22, 23, the conveying motors 24 to 28, and the discharging motor 29 based on the result of detection by each of the detection members 20 and an output value of the encoder that detects the amount of rotation of each drive roller to control the conveyance of the entire apparatus.

Figure 9C:
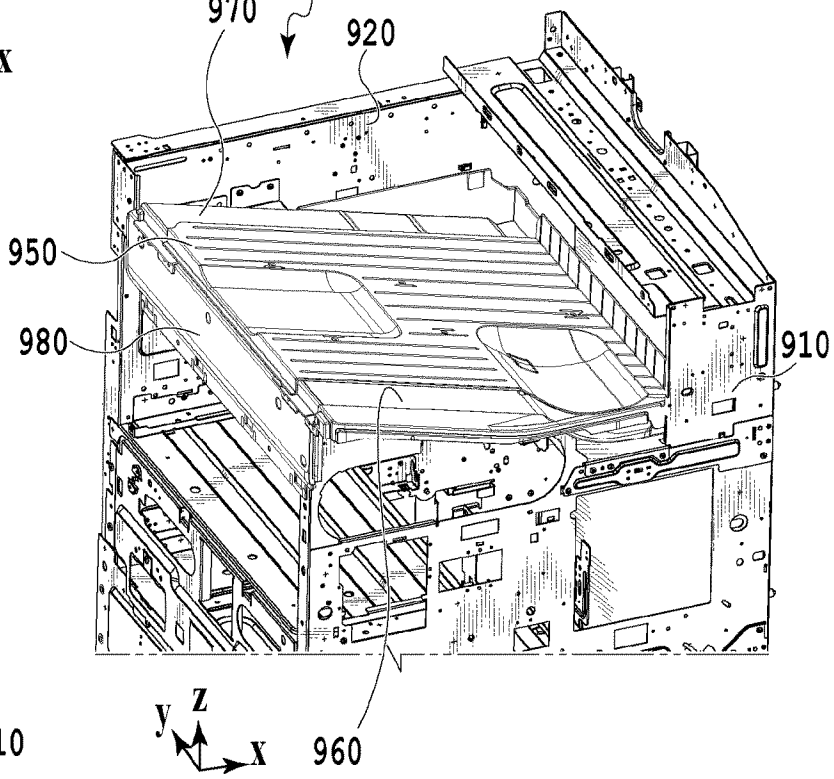
FIGS. 9A to 9C are diagrams showing the configuration and installation position of a discharging tray.
Figure 9B:
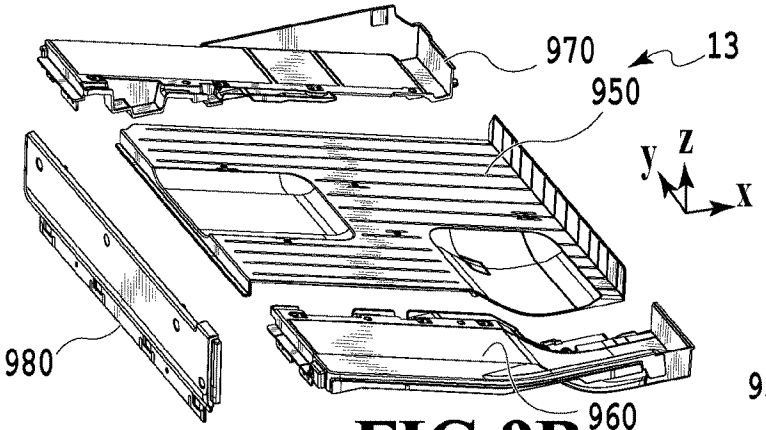
Figure 9A:
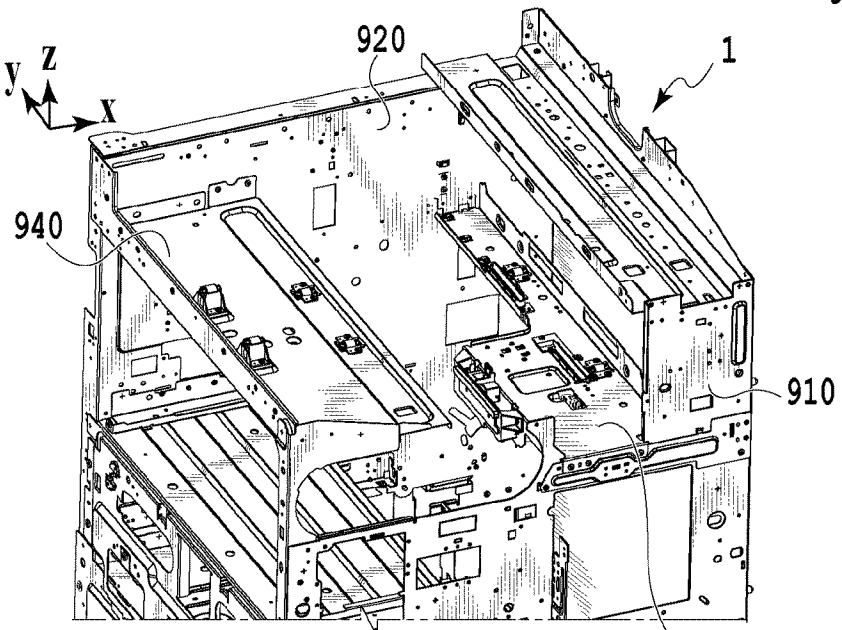

FIGS. 9A to 9C are diagrams for describing the configuration and installation position of the discharging tray 13.

FIG. 9A shows the location of the installation of the discharging tray 13 in the printing apparatus 1. A casing 4 of the printing apparatus 1 that houses an image printing unit includes a first side plate 910 on the near side of the front side (−y-direction side) and a second side plate 920 on the deep side of the front side (+y-direction side). The first side plate 910 and the second side plate 920 are made of sheet metal to secure the rigidness of the entire printing apparatus 1. In addition, a first frame 930 and a second frame 940, which are also made of sheet metal and have surfaces parallel to a horizontal plane, are fixed so as to couple the first side plate 910 to the second side plate 920. The discharging tray 13 according to the present embodiment is mounted between the first side plate 910 and the second side plate 920 and on the first frame 930 and the second frame 940 which are bridged over therebetween.

FIG. 9B is a diagram showing the configuration of the discharging tray 13. The discharging tray 13 includes a movable tray 950, a first fixed tray 960, a second fixed tray 970, and a tray side cover 980.

At the time of assembling the printing apparatus, first, the first fixed tray 960 and the second fixed tray 970 are mounted so as to bridge over the first frame 930 and the second frame 940. At this time, the first fixed tray 960 is disposed on the near side to be fixed to the first side plate 910. The second fixed tray 970 is disposed on the deep side to be fixed to the second side plate 920.

Next, the movable tray 950 is likewise mounted to bridge over the first frame 930 and the second frame 940. At this time, the movable tray 950 is mounted to partially overlap the first fixed tray 960 and the second fixed tray 970 in the y-direction (widthwise direction to be described later) so as to fill the gap between those trays 960 and 970. That is, the first fixed tray 960 supports part of one side of the movable tray 950, and the second fixed tray 970 supports part of the other side of the movable tray 950.

A print medium S on which an image has been printed is discharged onto this discharging tray 13 in a −x-direction from a +x-direction in the diagram. Hereinafter, the x-direction in the diagram is referred to as "discharging direction," and the y-direction crossing (orthogonal to in the present embodiment) the x-direction is referred to as "widthwise direction." Further, the +x-direction side is referred to as "upstream side in the discharging direction," and the −x-direction side is referred to as "downstream side in the discharging direction."

As shown in FIG. 9C, the discharging tray 13 is inclined so that the upstream side in the discharging direction becomes lower. This is because the second frame 940 located downstream is disposed at a higher position in the vertical direction than the first frame 930 located upstream. Moreover, the movable tray 950 is movable in the widthwise direction while keeping the overlapping relationship with the first fixed tray 960 and the second fixed tray 970.

Figure 10A:
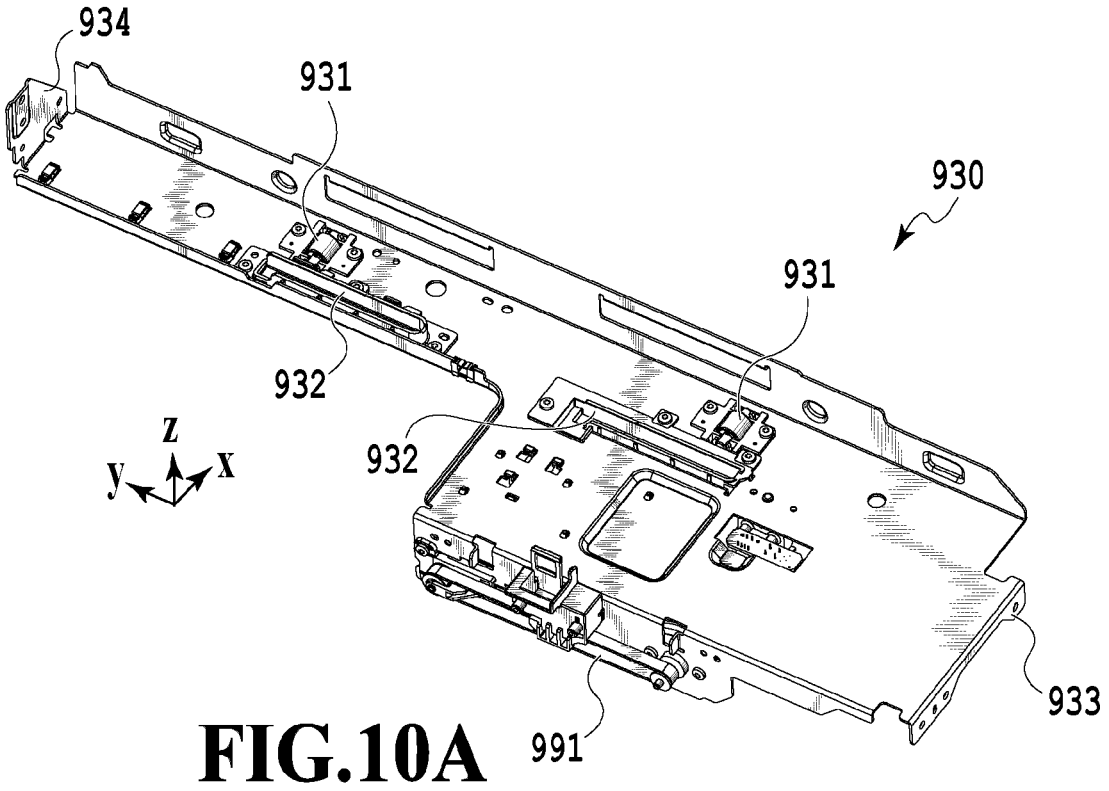
FIGS. 10A and 10B are enlarged perspective views of a first frame and a second frame.
Figure 10B:
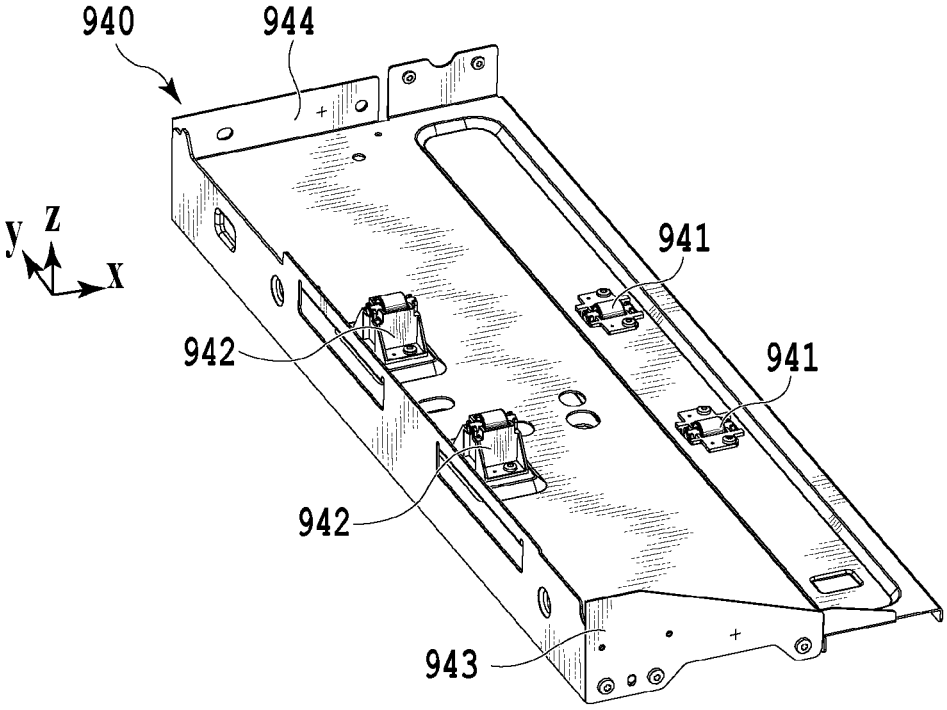

FIGS. 10A and 10B are enlarged perspective views of the first frame 930 and the second frame 940. As shown in FIG. 10A, the first frame 930 is provided with first support members 931 and guide members 932 which abut on the back side of the movable tray 950. A roller for assisting movement of the movable tray 950 is attached to the first support member 931. The guide member 932 is a groove extending in the axial direction, and engages with an engagement part 954 (see FIG. 11) of the movable tray 950 to guide the movable tray 950.

A tray motor 990 (see FIG. 12) is disposed on the back side of the first frame 930, and a drive transmission unit 991 for transmitting drive force of the tray motor 990 to the movable tray 950 is provided on the downstream side surface of the first frame 930. Such a first frame 930 is fixed to the first side plate 910 (see FIGS. 9A to 9C) and the second side plate 920 (see FIGS. 9A to 9C) by two mounting surfaces 933 and 934.

As shown in FIG. 10B, second support members 941 and third support members 942 which abut on the back side of the movable tray 950 are provided on the second frame 940. Rollers for assisting movement of the movable tray 950 are also attached to the second support members 941 and the third support members 942 as done to the first support members 931. Since the movable tray 950 is arranged in such a way that the upstream side in the discharging direction is lower than the downstream side, the rollers of the third support members 942 positioned on the most downstream side in the discharging direction are held at positions higher than the rollers of the second support members. Such a second frame 940 is fixed to the first side plate 910 (see FIGS. 9A to 9C) and the second side plate 920 (see FIGS. 9A to 9C) by two mounting surfaces 943 and 944.

Although the first frame 930 and the second frame 940 have been described above as separate components, those frames may be an integrated frame. In this case, however, it is required that the integrated frame should have a step-like shape or an inclined shape which has a surface for supporting the movable tray 950 at a relatively low position in the vertical direction and a surface for supporting the movable tray 950 at a relatively high position.

Figure 11:
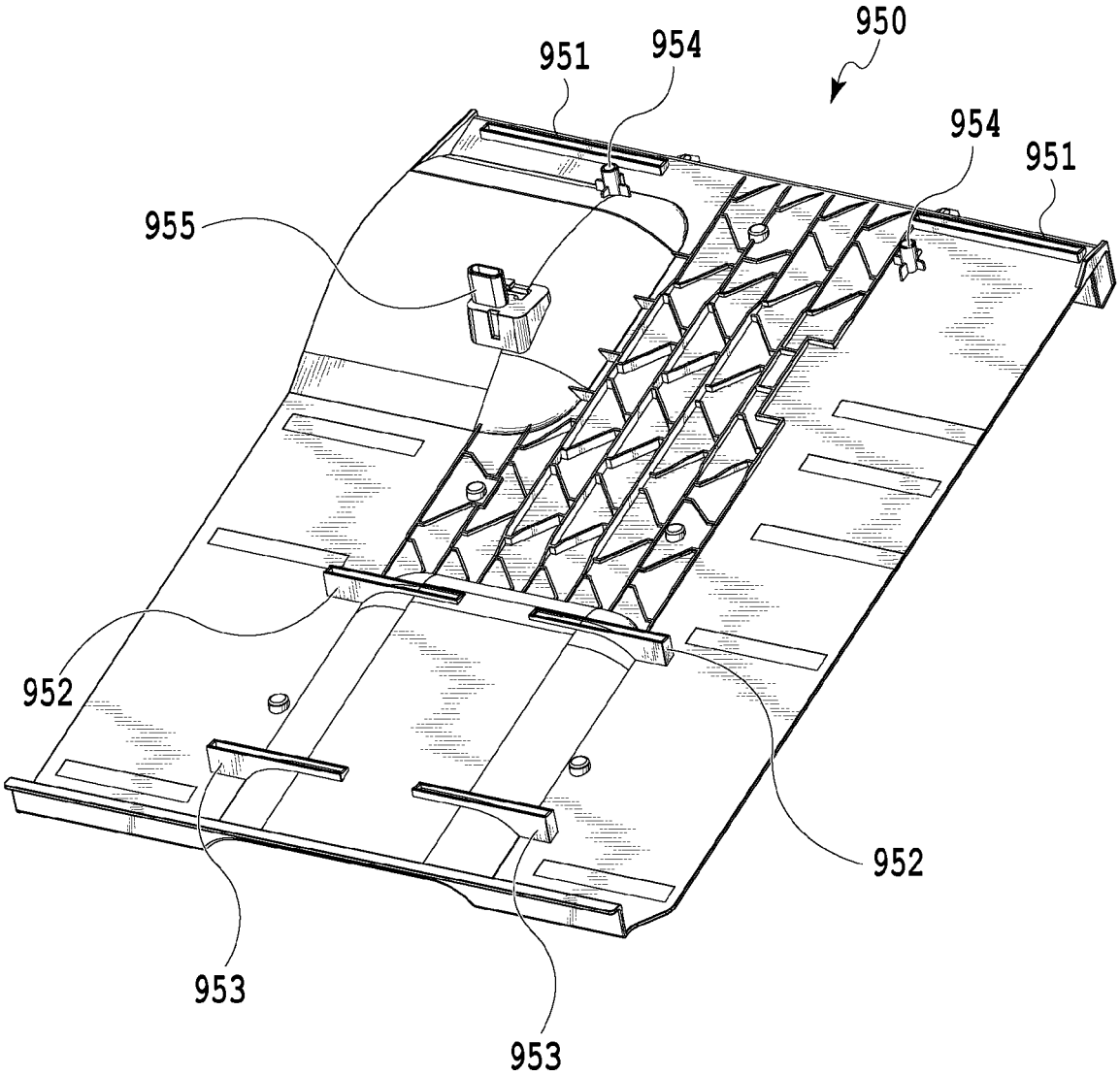
FIG. 11 is a diagram showing the back side of a movable tray.

FIG. 11 is a diagram showing the back side of the movable tray 950 which abuts against the first frame 930 and the second frame 940.

A first abutment part 951, a second abutment part 952 and a third abutment part 953 are grooves extending in the widthwise direction to respectively engage with the first support member 931, the second support member 941 and the third support member 942. The engagement part 954 engages with the first guide member 932 of the first frame 930. A drive coupling part 955 is a projection for coupling to the drive transmission unit 991. As the drive coupling part 955 is moved by the drive transmission unit 991, the entire movable tray 950 moves in the widthwise direction.

Figure 12:
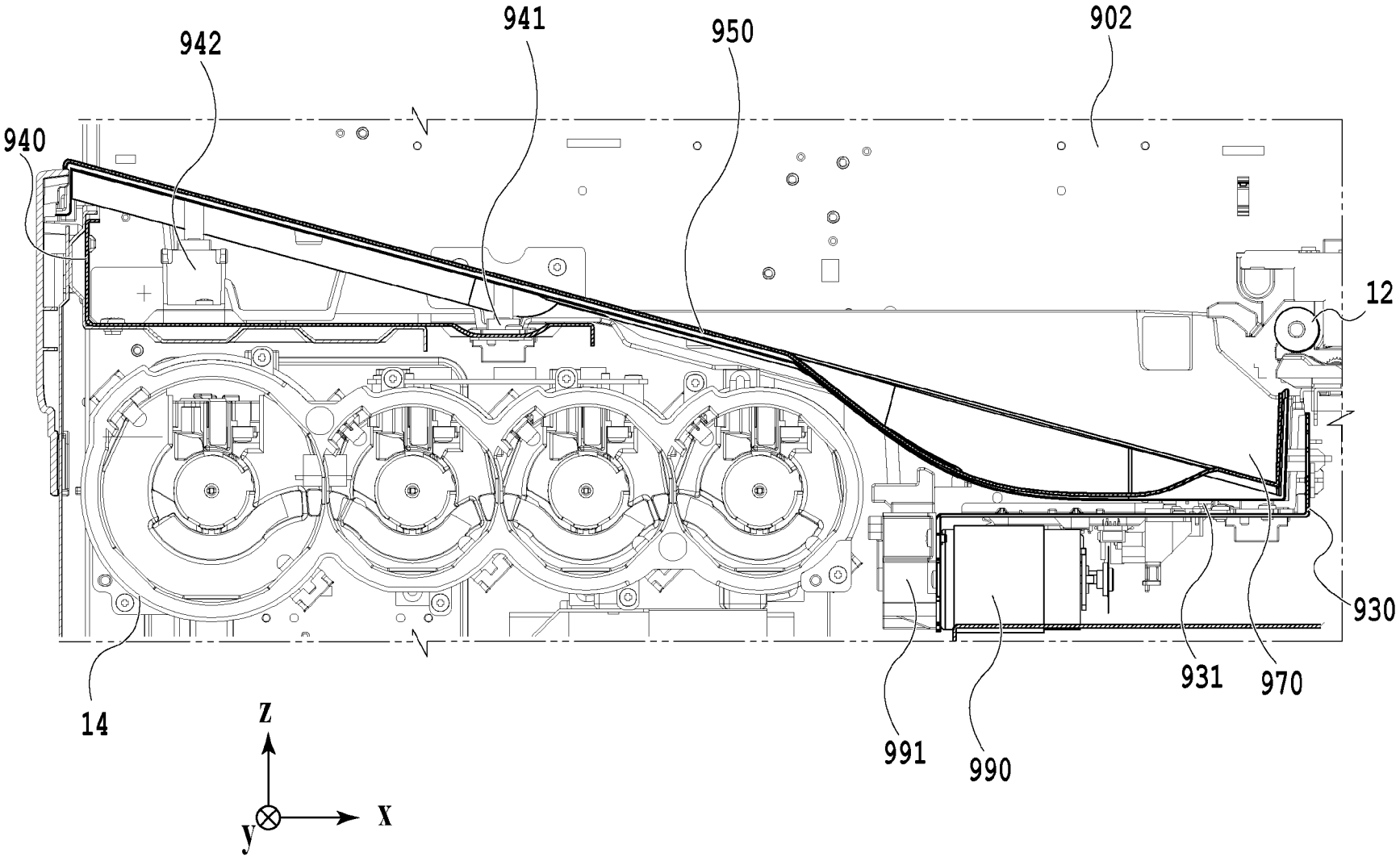
FIG. 12 is a cross-sectional view of a discharging tray mounted in the printing apparatus.

FIG. 12 is a cross-sectional view of the discharging tray 13 mounted on the printing apparatus 1. In the discharging direction, the second frame 940 is disposed farther from the discharging roller 12 and higher in the vertical direction than the first frame 930. Accordingly, the movable tray 950 supported by the first frame 930 and the second frame 940 houses a print medium S discharged from the discharging roller 12 in a state inclined to the horizontal direction. Therefore, after the rear end of a print medium S discharged from the discharging roller 12 is released from the nip portion of the discharging roller 12, the print medium S is brought close to the upstream side end portion of the movable tray 950 by gravity and stacked with the rear end of the print medium S aligned with the rear ends of the underlying print medium.

The tray motor 990 for moving the movable tray 950 is disposed on the bottom surface of the first frame 930, so that the drive force of the tray motor 990 is transmitted to the movable tray 950 via the drive transmission unit 991. Disposed under the second frame 940 is the ink tank unit 14 which retains inks of four colors to be supplied to the print head 8. That is, in the space below the inclined discharging tray 13, the relatively small tray motor 990 is disposed on the side where the space in the height direction is narrow, and the relatively large ink tank unit 14 is disposed on the side where the space in the height direction is wide. As just described, in the present embodiment, the overall size of the printing apparatus 1 is made small by arranging various members and mechanisms which constitute the image printing unit as closely as possible vertically under the discharging tray 13.

Figure 13A:
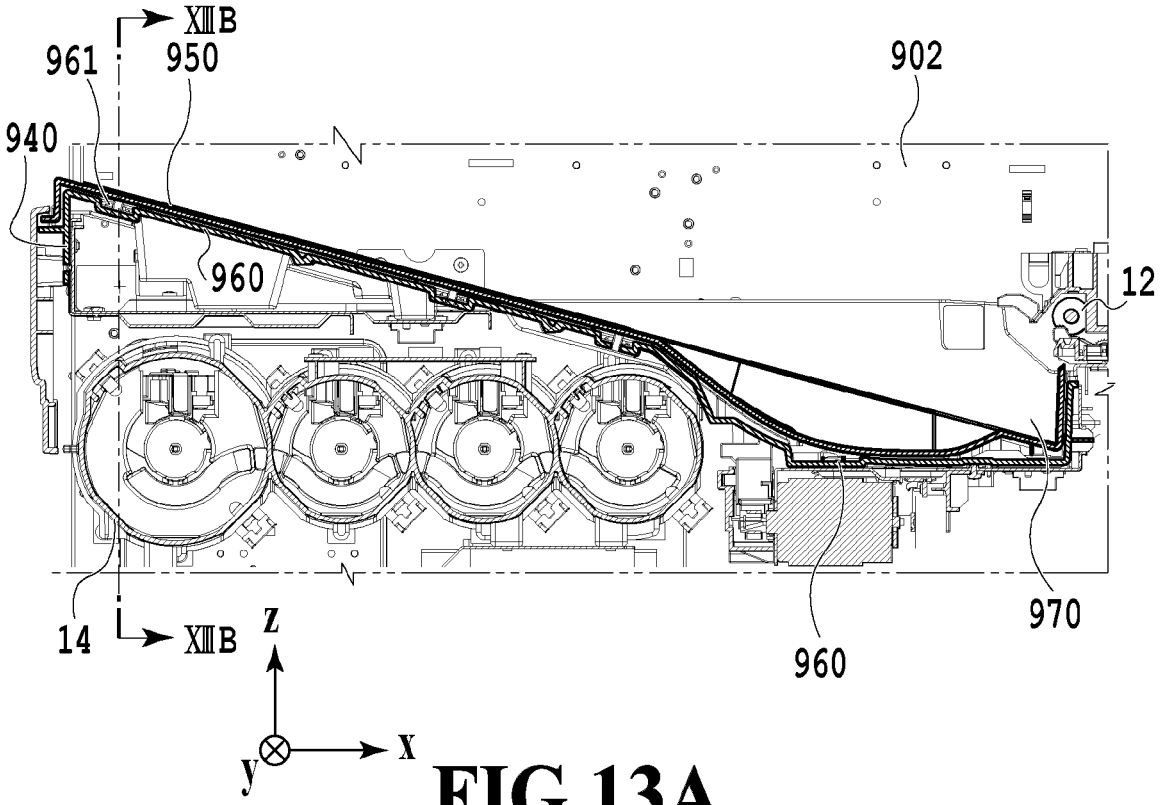
FIGS. 13A and 13B are diagrams showing abutment of the movable tray on a first fixed tray.
Figure 13B:
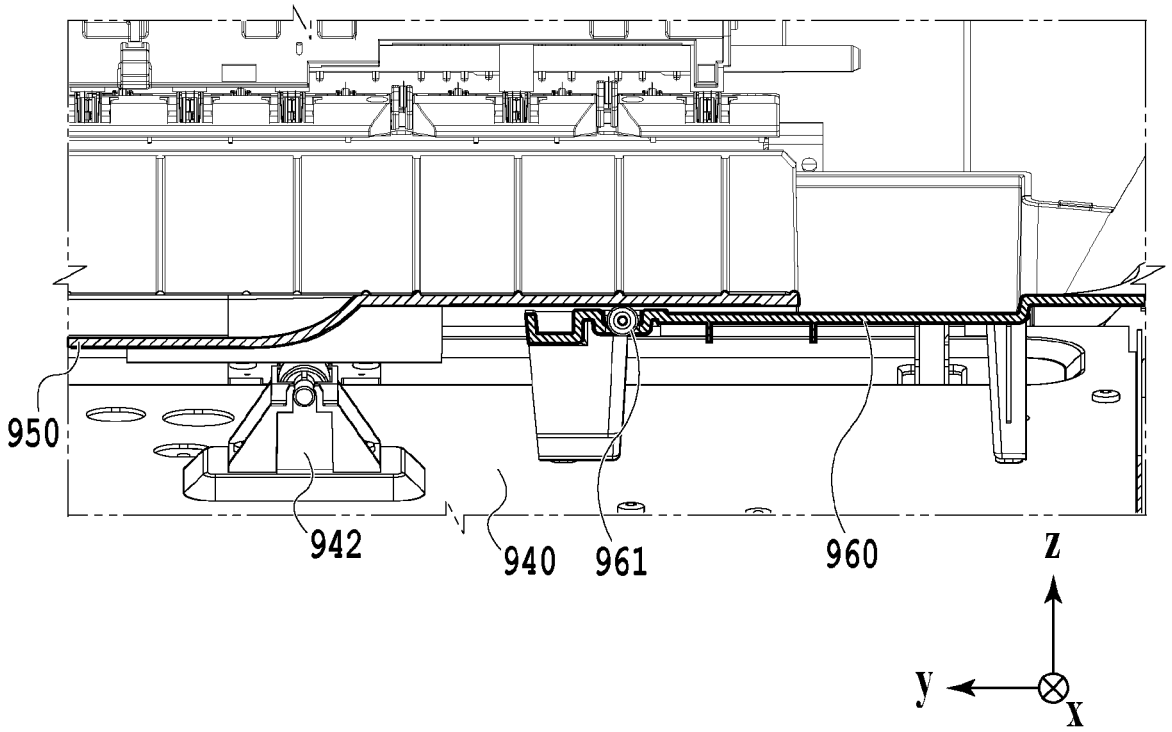

FIGS. 13A and 13B are diagrams showing the movable tray 950 and the first fixed tray 960 in abutment on each other. FIG. 13A is a cross-sectional view, and FIG. 13B is a cross-sectional view as seen from the direction of line XIIIB in FIG. 13A. As shown in the diagrams, a roller-like inter-tray support member 961 is disposed on the first fixed tray 960 at a position where the inter-tray support member 961 abuts the movable tray 950, and rotates as the movable tray 950 moves in the widthwise direction (y-direction in the diagrams). Therefore, even in a case where a number of print medium are stacked on the movable tray 950, the inter-tray support member 961 can smoothly move the movable tray 950 while receiving the load. The same is true of the abutment of the movable tray 950 against the second fixed tray 970.

In the discharging tray 13 according to the present embodiment, in addition to the inter-tray support member 961, the first, second and third support members (931, 941, 942) have roller members. Therefore, abutment of the movable tray 950 on the first and second frames 930, 940, and abutment of the movable tray 950 on the first and second fixed trays 960, 970 are both implemented via the roller members, so that rubbing between those members can be suppressed and can be prevented from being damaged even in a case where the movable tray 950 moves. It is also possible to reduce the load of the tray motor 990 and accurately control the movement of the movable tray 950.

With the foregoing configuration, the conveyance control unit 207 switches the discharging operation of the discharging tray 13 based on whether or not a "sorted discharging process" is set in a print command. Specifically, in a case where a print command in which a "sorted discharging process" is not set is input, the conveyance control unit 207 drives the conveying motors 24 to 28 and the discharging motor 29 to convey a print medium, and discharges the print medium from the discharging roller 12 without driving the tray motor 990. As a result, a plurality of print medium S consecutively discharged are stacked on the movable tray 950 at the same position with the rear ends aligned along the inclination of the movable tray 950.

In a case where a print command in which a "sorted discharging process" is set is input, on the other hand, the conveyance control unit 207 drives the tray motor 990 while driving the conveying motors 24 to 28 and the discharging motor 29 to convey a print medium. Specifically, the conveyance control unit 207 moves the movable tray 950 to a plurality of discharging positions provided in the widthwise direction in synchronism with the timings of discharging a plurality of print medium. As a result, a plurality of print medium S discharged from the discharging port are sorted and stacked on the movable tray 950 at a plurality of different positions in the widthwise direction.

In a case where plural sets of print medium each consisting of five print medium as a job are to be output, a first set is discharged in a case where the movable tray 950 is at a first position (at the rear or front), and a second set is discharged in a case where the movable tray 950 is at a second position (at the front or rear). Print medium which have been printed in response to a first command are discharged on the movable tray 950 positioned at the first position (at the rear or front), and in a case where a second command comes next, the print medium are discharged with the movable tray 950 being at the second position (at the front or rear).

According to the present embodiment described above, the first frame 930 and the second frame 940 are fixed to the first side plate 910 and the second side plate 920 which are part of the frame body of the apparatus body, and the discharging tray 13 is supported on the first frame 930 and the second frame 940. That is, the discharging tray 13 is supported by the members with a secured high strength which serve as part of the frame body of the apparatus body.

Even in a case where a number of print medium are discharged on the discharging tray 13, therefore, deformation of the support members (931, 941, 942) and the guide members 932 is small, so that print medium can be housed with higher rigidity secured than what is achieved by the related art. Even in a case where the movable tray 950 with a number of print medium stacked thereon is repeatedly moved and stopped, the then inertial force is regulated by the first side plate 910 and the second side plate 920 via the mounting surfaces (933, 934, 943, 944). As a result, the movement of the movable tray 950 can be controlled accurately and reliably without causing deformation of those regulating members or applying an excessive load to the tray motor 990. Therefore, the printing apparatus 1 can perform a reliable and stable "sorted discharging process."

In addition, according to the foregoing configuration, the first fixed tray 960, the second fixed tray 970 and the movable tray 950 are directly fixed to the frames serving as part of the frame body of the apparatus body, so that even in a case where the tray is made thin, the tray can maintain the rigidity. Therefore, the height from the top surface of the discharging tray 13 in the vertical direction to the discharging roller 12 can be extended as compared with the related art, so that the maximum quantity of print medium retainable on the discharging tray 13 can be increased.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2018-104695, filed May 31, 2018, which is hereby incorporated by reference wherein herein in its entirety.

What is claimed is:

1. A medium-stacking apparatus comprising:

a first side plate and a second side plate configured to be part of a frame body and to face each other in a widthwise direction crossing a discharging direction in which a print medium on which an image has been printed is discharged;

a first frame configured to couple the first side plate and the second side plate together in the widthwise direction;

a second frame configured to couple the first side plate and the second side plate together in the widthwise direction, the second frame being positioned away from the first frame and positioned downstream of the first frame in the discharging direction;

a movable tray, which is placed on the first frame and the second frame and which is supported by the first frame and the second frame from below, the movable tray being configured to be movable between the first side plate and the second side plate in the widthwise direction, and to receive a discharged print medium;

a first support member configured to support the movable tray, the first support member being attached on the first frame and positioned under the movable tray in the vertical direction;

a second support member configured to support the movable tray, the second support member being attached on the second frame and positioned under the movable tray in the vertical direction; and a drive unit configured to move the movable tray in the widthwise direction.

2. The medium-stacking apparatus according to claim 1, wherein the second frame is disposed above the first frame in the vertical direction, and wherein the movable tray is supported in such a way that a downstream side of the movable tray in the discharging direction is set higher in a vertical direction than an upstream side thereof.

3. The medium-stacking apparatus according to claim 2, wherein the drive unit is disposed under the movable tray in the vertical direction, and wherein an ink tank unit configured to store ink to be supplied to an image printing unit is disposed downstream of the drive unit in the discharging direction.

4. The medium-stacking apparatus according to claim 1, further comprising:

a first fixed tray configured to be fixed to the frame to support one side of the movable tray in the widthwise direction; and a second fixed tray configured to be fixed to the frame to support the other side of the movable tray in the widthwise direction.

5. The medium-stacking apparatus according to claim 4, wherein the first fixed tray and the second fixed tray have roller members that rotate according to a movement of the movable tray while supporting the movable tray.

6. The medium-stacking apparatus according to claim 1, wherein the first support member and the second support member have a roller member that supports the movable tray while rotating as the movable tray moves in the widthwise direction.

7. The medium-stacking apparatus according to claim 1, further comprising:

guide members configured to be provided on the first frame and the second frame and to guide a movement of the movable tray in the widthwise direction.

8. The medium-stacking apparatus according to claim 1, wherein the first side plate, the second side plate, the first frame, and the second frame are made of sheet metal.

9. The medium-stacking apparatus according to claim 1, wherein the movable tray and the first frame and the second frame are disposed above an image printing unit in a vertical direction.

10. The medium-stacking apparatus according to claim 1, further comprising an image printing unit configured to print an image on the print medium by using a full line type inkjet print head that ejects ink according to image data.

11. The medium-stacking apparatus according to claim 1, wherein the first support member and the drive unit are attached on the first frame.

12. The medium-stacking apparatus according to claim 1, further comprising an image printing unit configured to print an image on a print medium, wherein the frame body houses the image printing unit.

13. A medium-stacking apparatus comprising:

a first side plate and a second side plate configured to be part of a frame body and to face each other in a widthwise direction crossing a discharging direction in which a print medium on which an image has been printed is discharged;

a movable tray configured to be movable between the first side plate and the second side plate in the widthwise direction, and to receive a discharged print medium;

a support member configured to support the movable tray in a movable manner;

a drive unit configured to move the movable tray; and a frame configured to be fixed so as to couple the first side plate and the second side plate together in the widthwise direction, and to be equipped with the support member and the drive unit, wherein the drive unit is disposed under the movable tray in the vertical direction, and an ink tank unit configured to store ink to be supplied to an image printing unit is disposed downstream of the drive unit in the discharging direction.

14. The medium-stacking apparatus according to claim 13, wherein the movable tray is supported in such a way that a downstream side of the movable tray in the discharging direction is set higher in a vertical direction than an upstream side thereof.

15. The medium-stacking apparatus according to claim 13, further comprising an image printing unit configured to print an image on a print medium, wherein the frame body houses the image printing unit.

16. A medium-stacking apparatus comprising:

a first side plate and a second side plate configured to be part of a frame body and to face each other in a widthwise direction crossing a discharging direction in which a print medium on which an image has been printed is discharged;

a movable tray configured to be movable between the first side plate and the second side plate in the widthwise direction, and to receive a discharged print medium;

a support member configured to support the movable tray in a movable manner;

a drive unit configured to move the movable tray; and a frame configured to be fixed so as to couple the first side plate and the second side plate together in the widthwise direction, and to be equipped with the support member and the drive unit, wherein the frame includes (1) a first frame and (2) a second frame positioned downstream of the first frame in the discharging direction and disposed above the first frame in the vertical direction, wherein the support member of the first frame supports a part of one side of the movable tray in the discharging direction, wherein the support member of the second frame supports a part of the other side of the movable tray in the discharging direction, and wherein a central region of the movable tray in the discharging direction is not supported by a support member.

17. A medium-stacking apparatus according to claim 16, wherein the movable tray is supported in such a way that a downstream side of the movable tray in the discharging direction is set higher in a vertical direction than an upstream side thereof.

18. The medium-stacking apparatus according to claim 16, further comprising an image printing unit configured to print an image on a print medium, wherein the frame body houses the image printing unit.

* * * * *